US011179683B2

(12) United States Patent
Chen et al.

(10) Patent No.: US 11,179,683 B2
(45) Date of Patent: Nov. 23, 2021

(54) MICROBUBBLE GENERATION DEVICE AND EQUIPMENT

(71) Applicant: PetroChina Company Limited, Beijing (CN)

(72) Inventors: Xinglong Chen, Beijing (CN); Jiazhong Wu, Beijing (CN); Haishui Han, Beijing (CN); Shi Li, Beijing (CN); Hongwei Yu, Beijing (CN); Zemin Ji, Beijing (CN)

(73) Assignee: PETROCHINA COMPANY LIMITED, Beijing (CN)

( * ) Notice: Subject to any disclaimer, the term of this patent is extended or adjusted under 35 U.S.C. 154(b) by 259 days.

(21) Appl. No.: 16/426,768

(22) Filed: May 30, 2019

(65) Prior Publication Data

US 2020/0122098 A1 Apr. 23, 2020

(30) Foreign Application Priority Data

Oct. 22, 2018 (CN) ..... 201811228108.0

(51) Int. Cl.
*B01F 3/04* (2006.01)
*E21B 43/16* (2006.01)

(52) U.S. Cl.
CPC ..... *B01F 3/04255* (2013.01); *B01F 3/04262* (2013.01); *E21B 43/168* (2013.01);
(Continued)

(58) Field of Classification Search
CPC ..... B01F 3/04255; B01F 3/04262; B01F 2003/0431; B01F 2003/04858; B01F 3/04; E21B 43/168
See application file for complete search history.

(56) References Cited

U.S. PATENT DOCUMENTS 3,490,752 A * 1/1970 Martin ..... C02F 3/20 261/122.1
RE33,899 E * 4/1992 Tyer ..... B01F 3/04262 210/220

(Continued)

FOREIGN PATENT DOCUMENTS

CN 201236686 Y 5/2009
CN 101876242 A 11/2010

(Continued)

OTHER PUBLICATIONS

Chinese Search Report for Chinese Patent Application No. 20181228108.0, titled: Microbubble Generation Device and Equipment, dated Oct. 9, 2018 (With English Translation).

(Continued)

*Primary Examiner* — Stephen Hobson
(74) *Attorney, Agent, or Firm* — Hamilton, Brook, Smith & Reynolds, P.C.

(57) ABSTRACT

The present disclosure provides a microbubble generation device and equipment, wherein the microbubble generation device comprises: a microbubble generation mechanism having a housing and a core tube provided to pass therethrough, wherein at least one filter plate is provided on a peripheral sidewall of the housing, and an annular space is formed between the housing and the core tube; a flow rate control mechanism provided in the annular space, and connected to the core tube that is communicated with the annular space through the flow rate control mechanism, wherein a blocking ball is provided in the flow rate control mechanism and capable of blocking the flow rate control mechanism in a state that a pressure of gas injected into the flow rate control mechanism decreases; and a pressure balancing mechanism provided outside the housing and having a pressure balancing tube and a fluid check valve connected thereto. The present disclosure can withstand a huge pressure difference during a movement within a wellbore from a ground surface to an oil reservoir and take preventive measures for the failure. The gas injection process of the present disclosure not only meets the microbubble volume requirement, but also provides safe control measures.

20 Claims, 10 Drawing Sheets

(52) U.S. Cl.
CPC ..... *B01F 2003/04312* (2013.01); *B01F 2003/04858* (2013.01)

(56) References Cited

U.S. PATENT DOCUMENTS

| | | | | |
|---|---|---|---|---|
| 9,499,290 | B2 * | 11/2016 | Niazi | B65B 63/08 |
| 9,567,246 | B2 * | 2/2017 | Ko | B01F 3/04262 |
| 2015/0246835 | A1 * | 9/2015 | Ko | B01F 3/04262 210/151 |
| 2017/0050155 | A1 * | 2/2017 | Ueno | C02F 3/201 |
| 2019/0105616 | A1 * | 4/2019 | Baxter | B01F 3/04248 |
| 2019/0232236 | A1 * | 8/2019 | Nie | B01F 5/043 |
| 2020/0114319 | A1 * | 4/2020 | Galbreath-O'Leary | B01F 3/04255 |
| 2021/0010356 | A1 * | 1/2021 | Chen | E21B 43/168 |

FOREIGN PATENT DOCUMENTS

| | | | | |
|---|---|---|---|---|
| CN | 201818292 | U | 5/2011 | |
| CN | 202527087 | U | 11/2012 | |
| CN | 103880106 | A | 6/2014 | |
| CN | 105148819 | A | 12/2015 | |
| CN | 105521720 | A | 4/2016 | |
| CN | 206957678 | U | 2/2018 | |
| CN | 207769571 | U | 8/2018 | |
| DE | 102012009282 | A1 * | 11/2013 | B01F 3/04269 |
| JP | 2005-49354 | A | 12/2005 | |
| WO | WO-2012157798 | A1 * | 11/2012 | B01F 3/04269 |
| WO | WO-2015064382 | A1 * | 5/2015 | C01B 15/027 |
| WO | WO-2017132778 | A1 * | 8/2017 | C02F 3/20 |

OTHER PUBLICATIONS

Chen, Ya et al., "Microcosmic drive mechanism of foamy heavy oil," Inner Mongolia Petrochemical Industry, No. 19, pp. 132-137 (2015) (With English Abstract).

Yang, Jia et al., "Simulation of cavitation bubble collapse and mico-bubble growth by lattice Boltzmann method," Journal of Nanjing University (Natural Sciences), vol. 53, No. 1, pp. 41-48 (Jan. 2017) (With English Translation).

* cited by examiner

MICROBUBBLE GENERATION DEVICE AND EQUIPMENT

RELATED APPLICATION

This application claims priority under 35 U.S.C. § 119 or 365 to Chinese, Application No. 201811228108.0, filed Oct. 22, 2018. The entire teachings of the above application are incorporated herein by reference.

TECHNICAL FIELD

The present disclosure relates to the technical field of oil field developments, and in particular to a microbubble generation device and equipment.

BACKGROUND ART

Currently, the microbubble generation technology is gradually rising in the fields of the greenhouse gas environmental protection and the oil displacement technology development. In the field of oil development, microbubbles are dispersed into water to form a dispersion system. During the oil displacement, microbubbles can enter the pores that the injected water is difficult to enter, thus improving the sweep efficiency and the recovery rate.

At present, the microbubble generation methods that can be applied under the industrial conditions mainly include an orifice plate method in which the gas forms microbubbles through micropores. In addition, a metal filter sheet with a porous structure is also an extension of this method. A metal filter sheet with a uniform pore size and micron level orifices can generate bubbles with a diameter ranging from 30 microns to 200 microns. This method is easy to meet the requirement of the high industrial flow and has a large development space. Currently, the filter sheets in the laboratory research and development stage usually have a diameter less than 5 cm, while a total bubble volume is less than 0.1 $m^3/d$ in the use of a single filter sheet, which is far from meeting the industrial application requirement (more than 5 $m^3/d$).

In a method for generating larger bubbles (the diameter ranges from 2 mm to 5 mm), the filter plate is bent into a cylindrical shape, with one end welded with a circular curved surface, and the other end welded with a connection thread. This method improves the pressure resistance to a certain extent, but it unsuitable for a filter plate with small pores, since the bending process can easily cause a local deformation of the small-pore material and a significant degradation of the performance.

SUMMARY OF THE INVENTION

An objective of the present disclosure is to provide a microbubble generation device and equipment, which can withstand a huge pressure difference during a movement within a wellbore from a ground surface to an oil reservoir and take preventive measures for the failure. The gas injection process of the present disclosure not only meets the microbubble volume requirement, but also provides safe control measures.

The above objective of the present disclosure can be achieved using the following technical solutions:

The present disclosure provides a microbubble generation device, comprising:

a microbubble generation mechanism having a housing and a core tube provided to pass therethrough, wherein at least one filter plate is provided on a peripheral sidewall of the housing, and an annular space is formed between the housing and the core tube;

a flow rate control mechanism provided in the annular space, and connected to the core tube that is communicated with the annular space through the flow rate control mechanism, wherein a blocking ball is provided in the flow rate control mechanism and capable of blocking the flow rate control mechanism in a state that a pressure of gas injected into the flow rate control mechanism decreases; and a pressure balancing mechanism provided outside the housing and having a pressure balancing tube and a fluid check valve connected thereto, wherein fluid outside the housing can flow into the annular space through the fluid check valve and the pressure balancing tube.

In the embodiment of the present disclosure, the flow rate control mechanism comprises:

a ball valve cylinder provided therein with a flow rate regulation orifice plate, wherein an upper end of the ball valve cylinder is provided with a first valve seat on which a valve ball can be seated;

a hydraulic tube, one end of which is connected to the first valve seat through a side hole tube that is provided with a plurality of flow holes and communicated with the annular space through the plurality of flow holes; and a ball valve tee connected to a lower end of the ball valve cylinder, the other end of the hydraulic tube and the core tube, respectively;

wherein a main piston body is provided to be sealable and movable in one end of the hydraulic tube, an auxiliary piston body is provided to be sealable and movable in the other end of the hydraulic tube, and the hydraulic tube between the main piston body and the auxiliary piston body is filled with a pressure transmission fluid; the other end of the hydraulic tube is provided therein with a second valve seat, on which the blocking ball is seated and provided to face the ball valve tee, the second valve seat is located between the auxiliary piston body and the ball valve tee, and the auxiliary piston body is connected to a push rod that can be provided to pass through the second valve seat.

In the embodiment of the present disclosure, an elastic support rod is telescopically connected to an inner wall of the other end of the hydraulic tube, and the blocking ball can be blocked on the second valve seat through the elastic support rod.

In the embodiment of the present disclosure, the hydraulic tube comprises a main hydraulic tube and an auxiliary hydraulic tube connected to each other; the main hydraulic tube is connected to the side hole tube, the auxiliary hydraulic tube is connected to the ball valve tee, and the auxiliary hydraulic tube is provided with a liquid adding hole.

In the embodiment of the present disclosure, the main piston body has an upper main piston provided to be sealable and movable in the main hydraulic tube, and a lower main piston located in the side hole tube; a spherical groove which can be matched with the valve ball is formed on an end surface of the lower main piston.

In the embodiment of the present disclosure, one end of the main hydraulic tube in connection with the side hole tube is connected to a retaining ring, a connection rod is connected between the upper main piston and the lower main piston and provided to pass through the retaining ring, and an outer diameter of the upper main piston is larger than an inner diameter of the retaining ring.

In the embodiment of the present disclosure, a gas check valve is connected between the flow rate control mechanism and the core tube, and gas in the core tube can flow into the flow rate control mechanism through the gas check valve.

In the embodiment of the present disclosure, the fluid check valve is connected to a filter.

In the embodiment of the present disclosure, an upper joint is in sealed connection with an upper end of the core tube, and a lower joint is in sealed connection with a lower end of the core tube; the upper joint is provided to be sealed with an upper end surface of the housing, and the lower joint is provided to be sealed with a lower end surface of the housing.

In the embodiment of the present disclosure, structures of the upper joint and the lower joint are the same, both comprising a connection block and an insertion portion connected thereto; the insertion portion can be in sealed connection with an end portion of the core tube, and the connection block is provided to be sealed with the upper end surface or the lower end surface of the housing; a tapered hole is provided on the connection block, a via-hole is provided on the insertion portion, and the core tube is communicated with the tapered hole through the via-hole.

In the embodiment of the present disclosure, the filter plate is made of titanium nanoparticles, having an average pore diameter of 2 microns.

In the embodiment of the present disclosure, the housing is rectangular, and two opposite sidewalls thereof are provided with one of the filter plates, respectively.

In the embodiment of the present disclosure, the filter plate is connected to the housing through a press plate frame, and a sealing ring is provided between the filter plate and the housing.

In the embodiment of the present disclosure, the filter plate is a flat plate.

The present disclosure further provides a microbubble generation equipment, comprising a plurality of microbubble generation devices aforementioned, every adjacent two of which are connected through a connection nipple.

The microbubble generation device and equipment have the following characteristics and advantages:

the pressure balance mechanism of the microbubble generation device can keep the filter plate intact in the process of being placed into the oil reservoir;

the flow rate control mechanism of the microbubble generation device can limit a maximum flow rate of the introduced gas, and when the flow rate of the introduced gas exceeds the design value, the flow rate control mechanism can be self-blocked to ensure the normal working of other devices in the serial tubing string;

the filter plate of the microbubble generation device has a large surface area, which can enable the filter plate to generate a certain volume of microbubbles at the oil reservoir, thereby meeting the industrial application conditions.

BRIEF DESCRIPTION OF THE DRAWINGS

In order to more clearly explain the technical solutions in the embodiments of the present disclosure, the drawings to be used in the description of the embodiments will be briefly introduced as follows. Obviously, the drawings in the following description just illustrate some embodiments of the present disclosure, and those skilled in the art can obtain other drawings from them without paying any creative effort.

REFERENCE NUMBERS

1: microbubble generation mechanism; 11: housing; 111: mounting groove; 12: core tube; 121: gas check valve; 13: filter plate; 14: annular space; 15: upper joint; 16: lower joint; 171: connection block; 172: insertion portion; 1721: external threaded section; 1722: necking section; 1723: sealing ring; 1724: O-shaped sealing ring; 173: tapered hole; 174: via-hole; 18: press plate frame; 181: connection hole; 182: connection screw; 19: sealing strip; 2: flow rate control mechanism; 21: ball valve cylinder; 211: flow rate regulation orifice plate; 2111: through-hole; 212: first valve seat; 213: valve ball; 214: side hole; 22: hydraulic tube; 221: main piston body; 2211: upper main piston; 2212: lower main piston; 2213: connection rod; 2214: spherical groove; 2215: sealing ring; 222: auxiliary piston body; 2221: push rod; 2222: sealing ring; 223: second valve seat; 224: blocking ball; 225: main hydraulic tube; 2251: connection hole; 2252: retaining ring; 226: auxiliary hydraulic tube; 2261: liquid adding hole; 227: support rod; 2271: spring; 23: ball valve tee; 231: external threaded section; 232: external threaded section; 233: threaded hole; 234: valve seat; 24: side hole tube; 241: flow hole; 3: pressure balancing mechanism; 31: pressure balancing tube; 32: fluid check valve; 33: filter; 4: plug; 5: casing; 51: perforation; 10: microbubble generation device; 101: connection nipple.

DETAILED DESCRIPTION OF THE PREFERRED EMBODIMENTS

Next, the technical solutions in the embodiments of the present disclosure will be clearly and completely described with reference to the drawings for the embodiments of the present disclosure. Obviously, those described are only a part, rather than all, of the embodiment of the present disclosure. Based on the embodiments of the present disclosure, any other embodiment obtained by those skilled in the art without paying any creative effort shall fall within the protection scope of the present disclosure.

Embodiment 1

Figure 1:
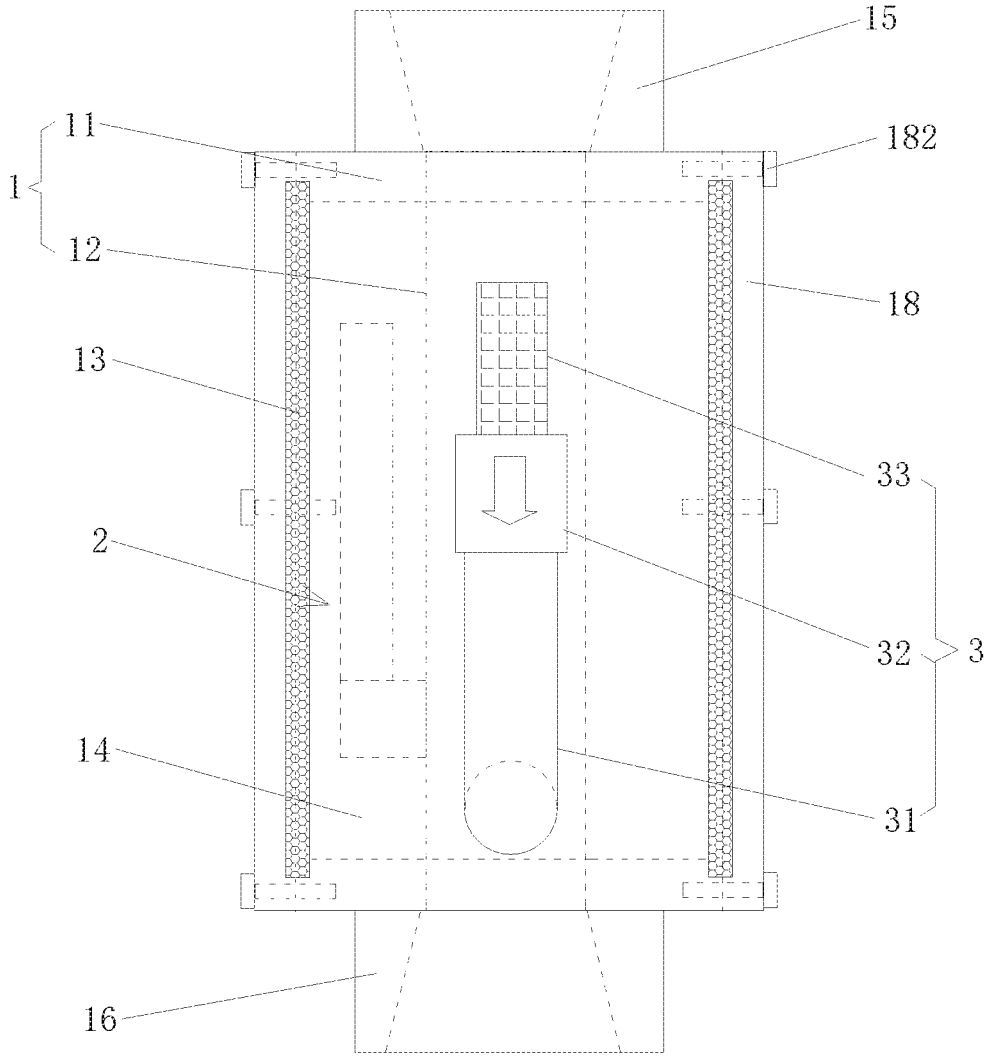
FIG. 1 is a front structure view of a microbubble generation device of the present disclosure.
Figure 2:
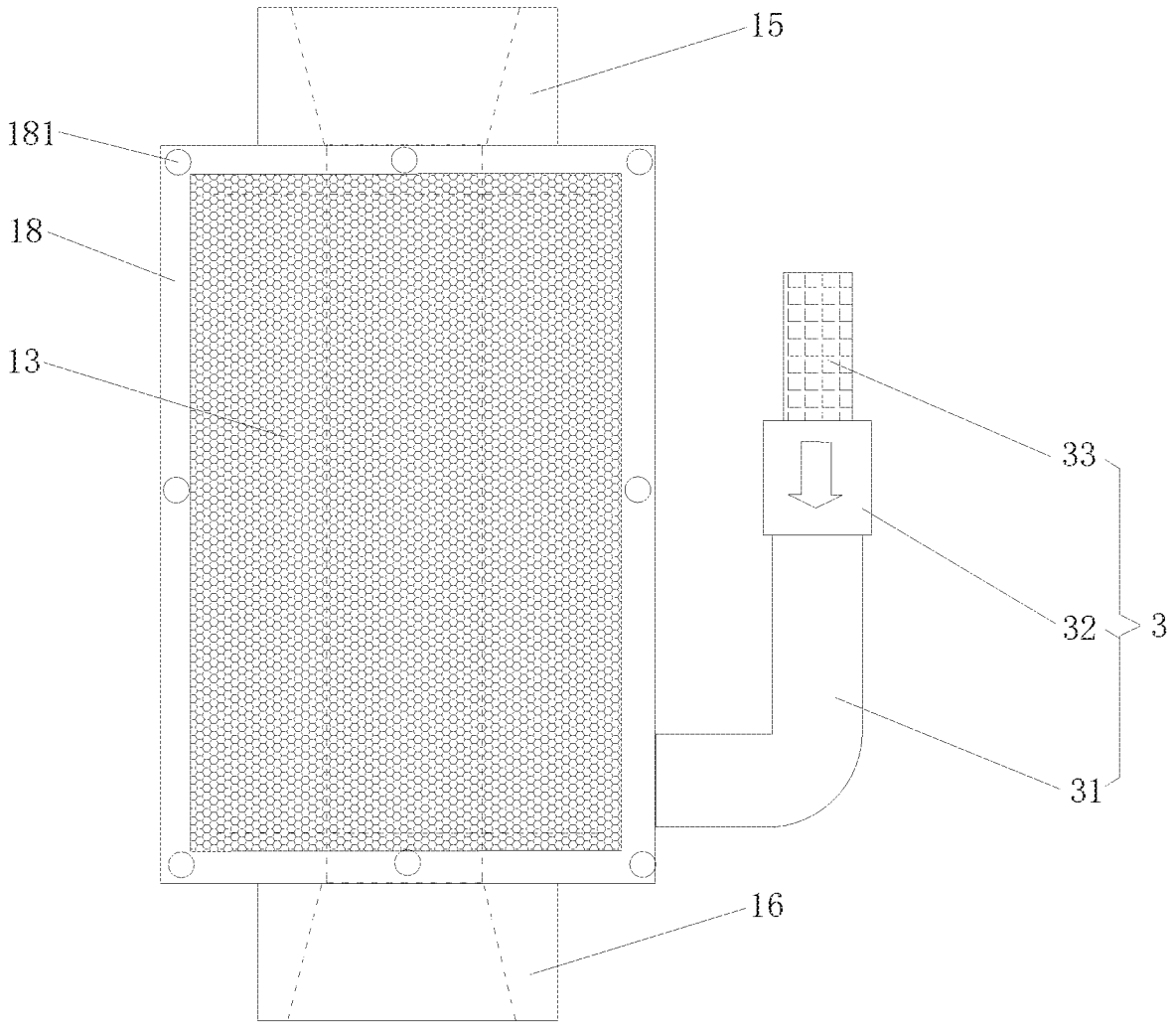
FIG. 2 is a side structure view of a microbubble generation device of the present disclosure.
Figure 3:
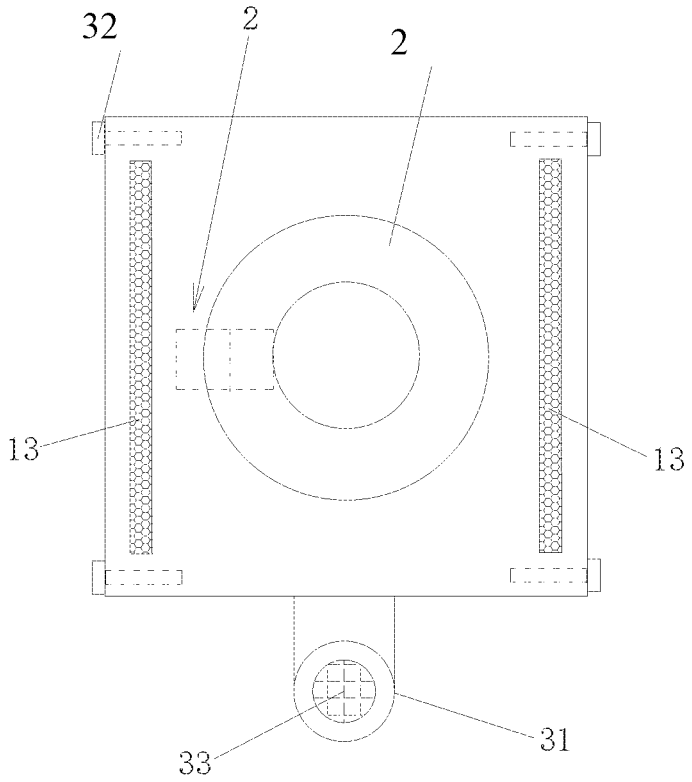
FIG. 3 is a top structure view of a microbubble generation device of the present disclosure.

As illustrated in FIGS. 1 to 3, the present disclosure provides a microbubble generation device, comprising a microbubble generation mechanism 1, a flow rate control mechanism 2 and a pressure balancing mechanism 3, wherein the microbubble generation mechanism 1 has an housing 11 and a core tube 12 provided to pass therethrough, at least one filter plate 13 is provided on a peripheral sidewall of the housing 11, and an annular space 14 is formed between the housing 11 and the core tube 12; the flow rate control mechanism 2 is provided in the annular space 14 and connected to the core tube 12 that is communicated with the annular space 14 through the flow rate control mechanism 2, and a blocking ball 224 is provided in the flow rate control mechanism 2 and capable of blocking the flow rate control mechanism 2 in a state that a pressure of gas injected into the flow rate control mechanism 2 decreases; the pressure balancing mechanism 3 is provided outside the housing 11 and has a pressure balancing tube 31 and a fluid check valve 32 connected thereto; and fluid outside the housing 11 can flow into the annular space 14 through the fluid check valve 32 and the pressure balancing tube 31.

Specifically, the microbubble generation mechanism 1 is a mechanism for generating microbubbles, and has a substantially rectangular frame-shaped housing 11 in which a substantially cylindrical core tube 12 is provided to pass therethrough. In the present disclosure, an upper joint 15 is in sealed connection with an upper end of the core tube 12, and a lower joint 16 is in sealed connection with a lower end of the core tube 12; the upper joint 15 is provided to be sealed with an upper end surface of the housing 11, and the lower joint 16 is provided to be sealed with a lower end surface of the housing 11, wherein the upper joint 15 can be threadedly connected to a gas injection tubing string, and the lower joint 16 can be connected to the upper joint 15 of the microbubble generation device of a next stage through a joint.

Figure 4:
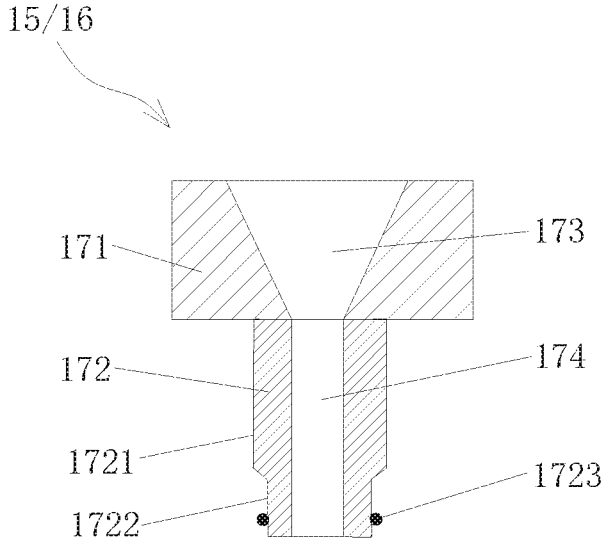
FIG. 4 is a structure view of an upper joint or a lower joint of a microbubble generation device of the present disclosure.
Figure 5:
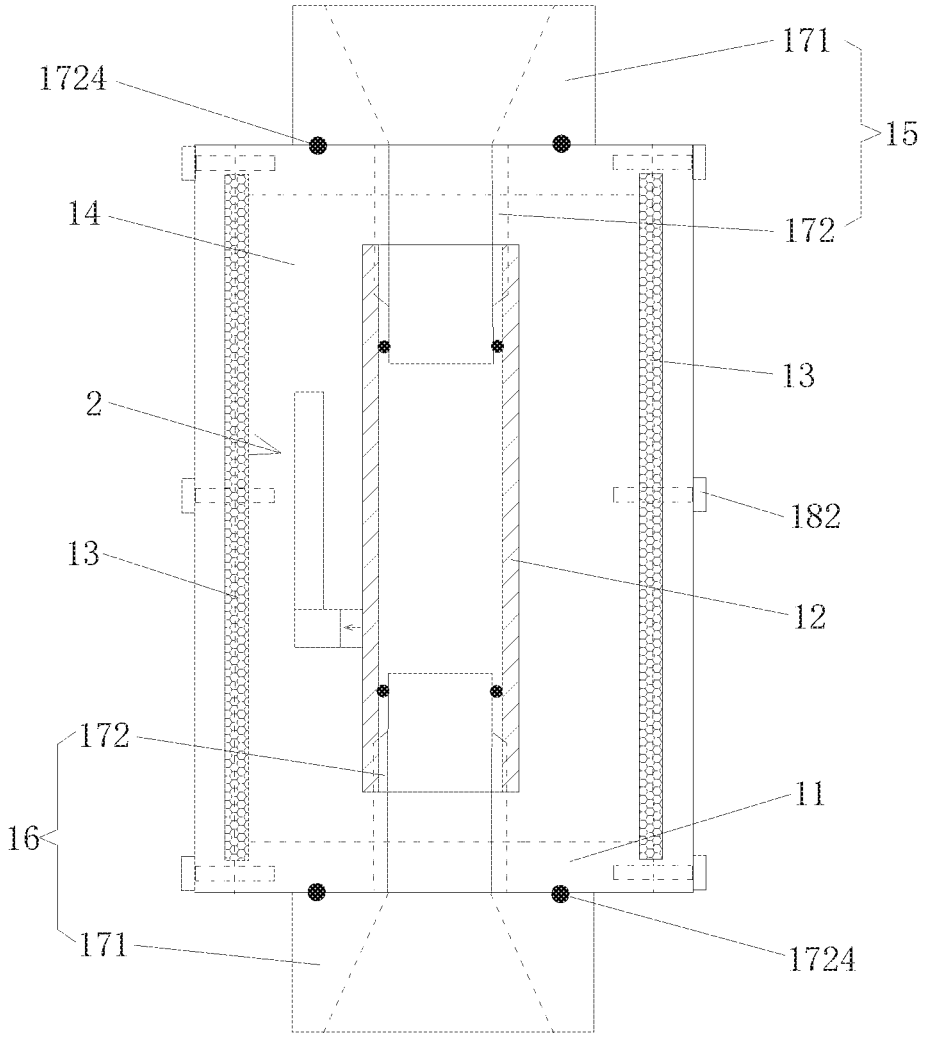
FIG. 5 is a cross-sectional structure view of a microbubble generation device of the present disclosure.

As illustrated in FIG. 4, structures of the upper joint 15 and the lower joint 16 are the same, both comprising a connection block 171 and an insertion portion 172 connected thereto; the insertion portion 172 can be in sealed connection with an end portion of the core tube 12, and the connection block 171 is provided to be sealed with the upper end surface or the lower end surface of the housing 11; a tapered hole 173 is provided on the connection block 171, a via-hole 174 is provided on the insertion portion 172, and the core tube 12 is communicated with the tapered hole 173 through the via-hole 174. In this embodiment, as illustrated in FIG. 5, the insertion portion 172 is substantially cylindrical and has an external threaded section 1721 and a necking section 1722; the insertion portion 172 can be inserted into the core tube 12 from the end portion of the core tube 12, and threadedly connected into the end portion of the core tube 12 through the external threaded section 1721, so as to ensure an overall stress stability. The necking section 1722 is sleeved with a sealing ring 1723, and provided to be sealed in the end portion of the core tube 12 through the sealing ring 1723. After the upper joint 15 is inserted into the upper end of the core tube 12 and the lower joint 16 is inserted into the lower end of the core tube 12, the connection block 171 of the upper joint 15 can be provided to be sealed on the upper end surface of the housing 11 through an O-shaped sealing ring 1724, and the connection block 171 of the lower joint 16 can be provided to be sealed on the lower end surface of the housing 11 through the O-shaped sealing ring 1724.

At least one filter plate 13 is provided on a peripheral sidewall of the housing 11. In the present disclosure, the filter plate 13 is made of titanium nanoparticles, having an average pore diameter of 2 microns, and a planar pore uniformity of more than 90%. In this embodiment, the filter plate 13 is a flat plate, i.e., a planar plate, not subjected to bending, deformation, welding and other structural change processes, so that the pore distribution uniformity is high, and a good bubble generation performance is maintained. In this embodiment, the housing 11 is rectangular, and two opposite sidewalls thereof are provided with one of the filter plates 13, respectively. Of course, in other embodiments, it is possible that only one sidewall of the rectangular housing 11 is provided with one of the filter plates 13, or two adjacent sidewalls of the rectangular housing 11 are provided with one of the filter plates 13, respectively, or three or four sidewalls of the rectangular housing 11 are provided with one of the filter plates 13, respectively, which is not limited herein.

Figure 6:
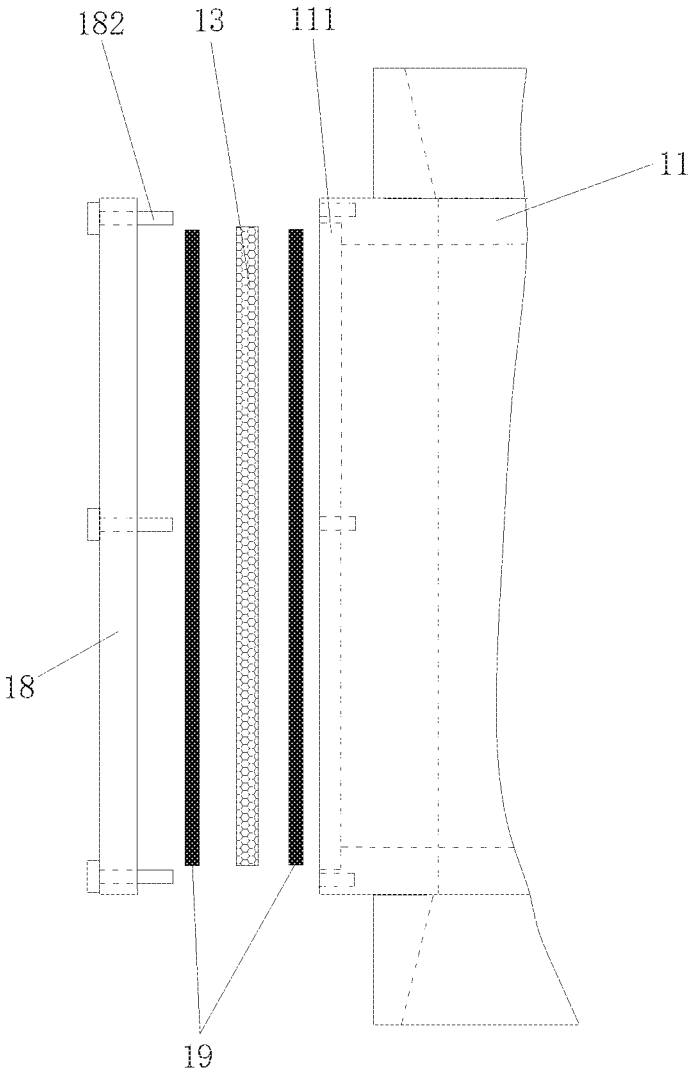
FIG. 6 is a structure view of a microbubble generation device of the present disclosure with a filter plate connected to a housing.
Figure 7:
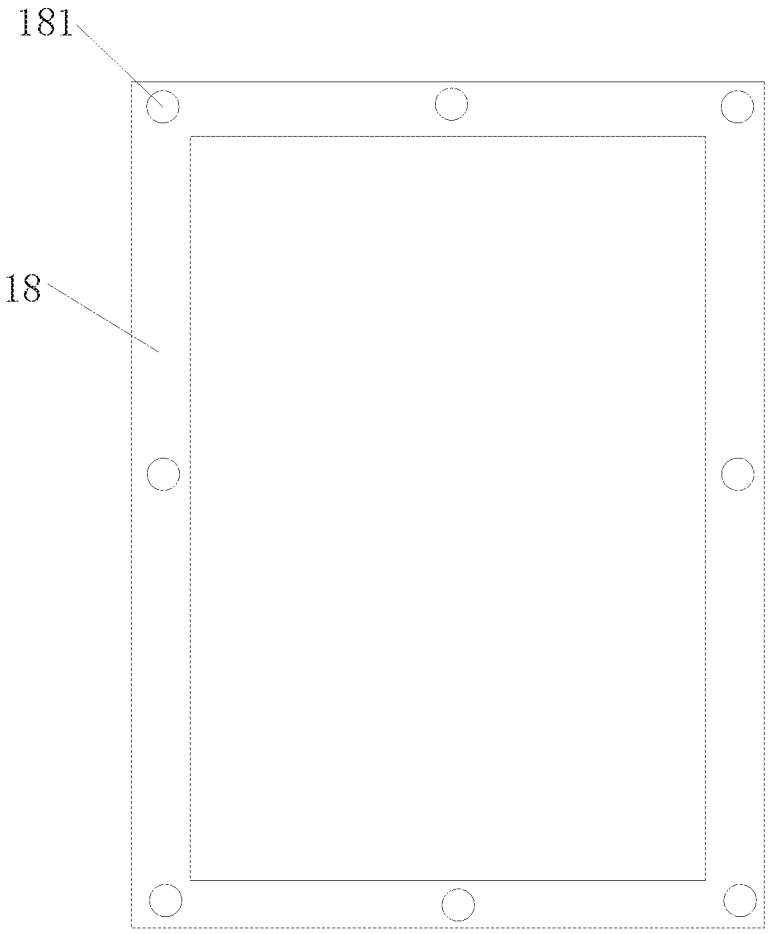
FIG. 7 is a structure view of a press plate frame in a microbubble generation device of the present disclosure.

Referring to FIG. 6, the filter plate 13 is connected to the housing 11 through a press plate frame 18. In this embodiment, a mounting groove 111 is provided on a sidewall of the housing 11 where the filter plate 13 is to be mounted; an outer periphery of the filter plate 13 is provided with sealing strips 19, through which a sealing between the filter plate 13 and the housing 11 is realized when the filter plate 13 is put into the mounting groove 111 of the housing 11; next, the filter plate 13 is fixed on the housing 11 through the press plate frame 18 as illustrated in FIG. 7; the press plate frame 18 is provided with a plurality of connection holes 181, in which a plurality of connection screws 182 are provided to pass therethrough and be threadedly connected into corresponding threaded holes on the housing 11, so that the press plate frame 18 is fixedly connected to the housing 11; the sealing strips 19 can further realize a sealing between the press plate frame 18 and the housing 11.

Viewed in a longitudinal direction, the filter plate 13 is not subjected to the pulling force of the tubing string and its length can be unrestricted, under the force protection of the upper joint 15, the core tube 12 and the lower joint 16, so that the bubble generating surface area is large, and the industrial application requirement can be met. In addition, by using the press plate frame 18, the housing 11 not only realizes a fixed connection with the filter plate 13, but also facilitates operations such as the mounting of the core tube 12 and the internal components by an operator after the pressure plate frame 18 is opened.

The flow rate control mechanism 2 is a mechanism for limiting a maximum gas flow, and when the gas flow rate exceeds a design value, the flow rate control mechanism 2 is self-blocked, i.e., blocked by the blocking ball 224 therein, so as to prevent the gas in the core tube 12 from flowing into the flow rate control mechanism 2. The flow rate control mechanism 2 can ensure the normal working of the identical devices connected in series up and down.

Figure 8:
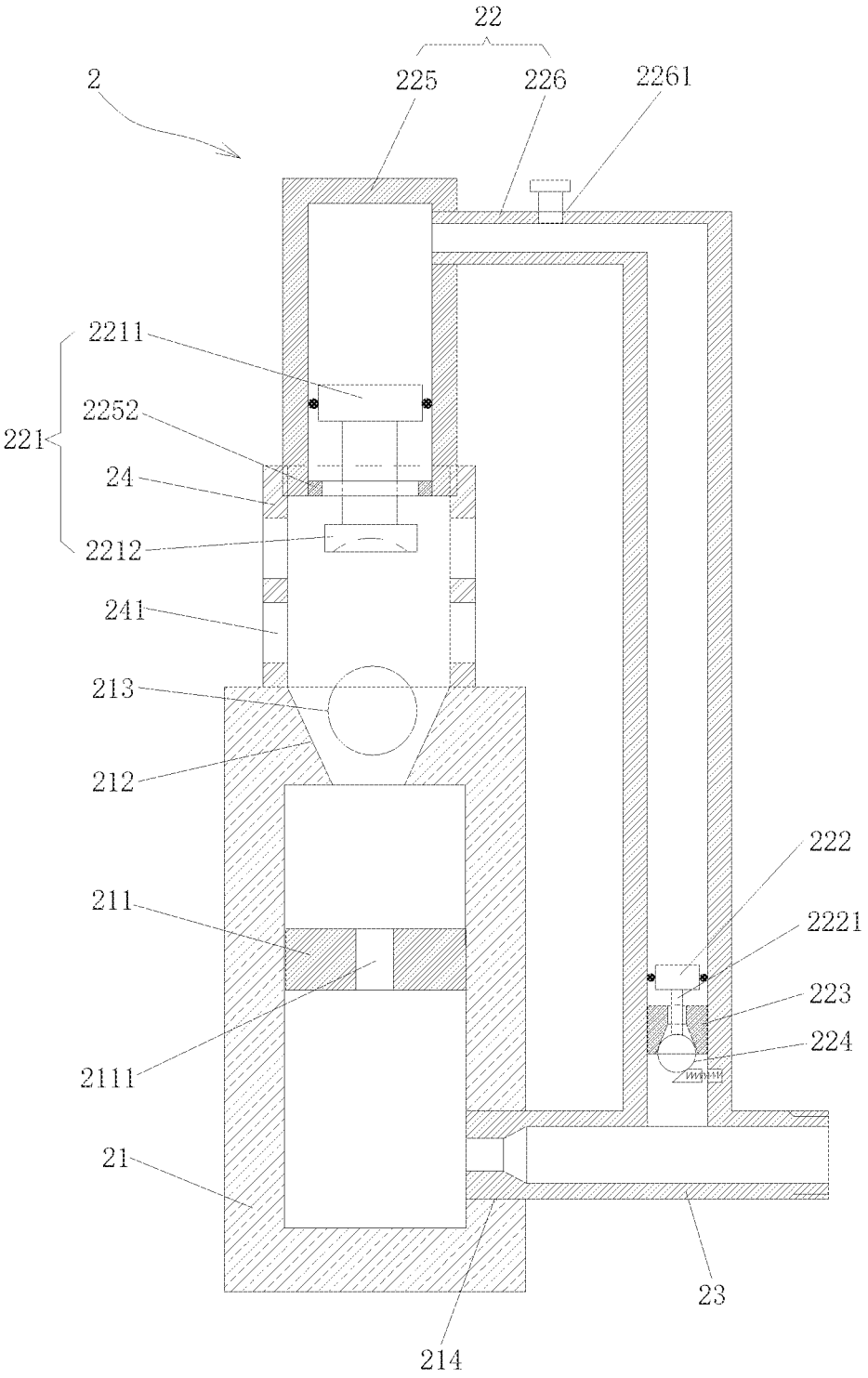
FIG. 8 is a structure view of a flow rate control mechanism in a microbubble generation device of the present disclosure.

As illustrated in FIG. 8, the flow rate control mechanism 2 comprises a ball valve cylinder 21, a hydraulic tube 22 and a ball valve tee 23, wherein a flow rate regulation orifice plate 211 is provided in the ball valve cylinder 21, a first valve seat 212 is provided on an upper end of the ball valve cylinder 21, and a valve ball 213 can be seated on the first valve seat 212; one end of the hydraulic tube 22 is connected to the first valve seat 212 through a side hole tube 24 that is provided with a plurality of flow holes 241 and communicated with the annular space 14 through the plurality of flow holes 241; and the ball valve tee 23 is connected to a lower end of the ball valve cylinder 21, the other end of the hydraulic tube 22 and the core tube 12, respectively; wherein a main piston body 221 is provided to be sealable and movable in one end of the hydraulic tube 22, an auxiliary piston body 222 is provided to be sealable and movable in the other end of the hydraulic tube 22, and the hydraulic tube 22 between the main piston body 221 and the auxiliary piston body 222 is filled with a pressure transmission fluid, which is engine oil in this embodiment, with a viscosity not less than 10 mPa·s under the normal temperature and the normal pressure; by using engine oil or oily liquid with a certain viscosity, it is helpful to the lubrication of the inner wall of the hydraulic tube 22 and also to the sealing. The other end of the hydraulic tube 22 is provided therein with a second valve seat 223 on which a blocking ball 224 is seated and provided to face the ball valve tee 23, the second valve seat 223 is located between the auxiliary piston body 222 and the ball valve tee 23, and the auxiliary piston body 222 is connected to a push rod 2221 that can be provided to pass through the second valve seat 223.

Specifically, the ball valve cylinder 21 is substantially cylindrical; a lower end of the ball valve cylinder 21 is provided with a side hole 214 to which one end of the ball valve tee 23 is connected, and an upper end of the ball valve cylinder 21 is connected to a first valve seat 212 on which a valve ball 213 can be seated; an interior of the ball valve cylinder 21 is connected to a flow rate regulation orifice plate 211, which is provided with a through-hole 2111 having an inner diameter smaller than that of an inner cavity of the ball valve cylinder 21. The gas enters a bottom of the ball valve cylinder 21 from the side hole 214 of the ball valve cylinder 21, and a flow rate of the gas is preliminarily regulated due to the resistance of the via-hole 2111 of the flow rate regulation orifice plate 211. Since the pressure in the ball valve cylinder 21 above the flow rate regulation orifice plate 211 is larger than the external pressure, the gas will thrust aside the valve ball 213 in the first valve seat 212 and be discharged out of the ball valve cylinder 21 from the first valve seat 212.

Figure 9:
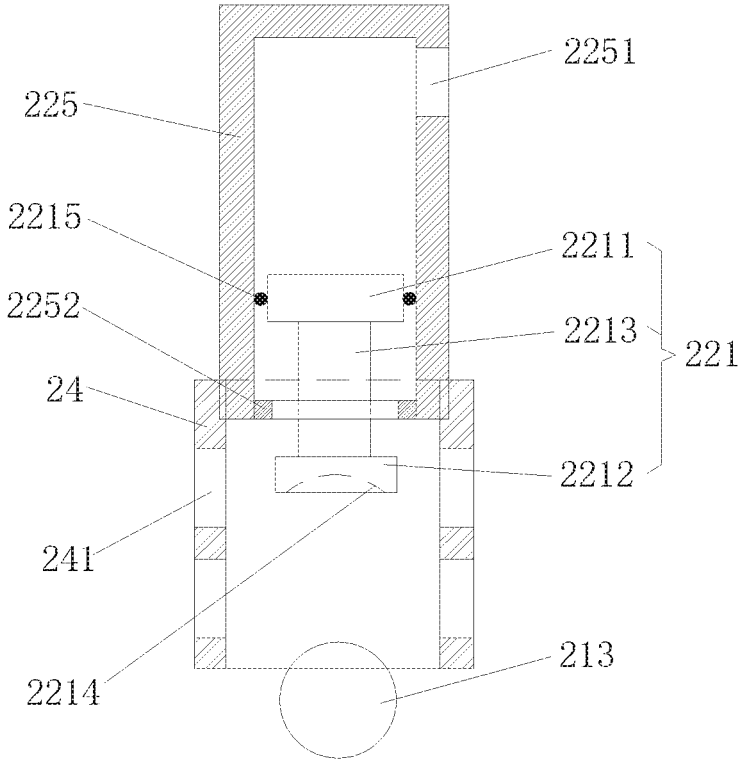
FIG. 9 is a structure view of a microbubble generation device of the present disclosure with a main hydraulic tube connected to a side hole tube.

Referring to FIG. 9, the side hole tube 24 is substantially cylindrical, a lower end of which is connected to the first valve seat 212; the side hole tube 24 is provided with a plurality of flow holes 241, through which the gas discharged from the first valve seat 212 can flow into the annular space 14.

The hydraulic tube 22 comprises a main hydraulic tube 225 and an auxiliary hydraulic tube 226 connected to each other; the main hydraulic tube 225 is connected to the side hole tube 24, and the auxiliary hydraulic tube 226 is connected to the ball valve tee 23; the auxiliary hydraulic tube 226 is provided with a liquid adding hole 2261 to facilitate the gas exhaust and the regulation of the amount of engine oil in the hydraulic tube 22.

Specifically, as illustrated in FIG. 9, the main hydraulic tube 225 is substantially cylindrical, a lower end of which is threadedly connected to the upper end of the side hole tube 24, and an upper end of which is provided with a connection hole 2251 to which one end of the auxiliary hydraulic tube 226 is connected. In this embodiment, a main piston body 221 is provided to be sealable and movable in the main hydraulic tube 225; the main piston body 221 has an upper main piston 2211 provided to be sealable and movable in the main hydraulic tube 225, and a lower main piston 2212 located in the side hole tube 24; a connection rod 2213 is connected between the upper main piston 2211 and the lower main piston 2212, a sealing ring 2215 is provided between the upper main piston 2211 and the inner wall of the main hydraulic tube 225, and a spherical groove 2214 which can be matched with the valve ball 213 is formed on an end surface of the lower main piston 2212, so as to uniformly receive an impact force of the valve ball 213 impacted from the first valve seat 212 by the gas. In this embodiment, a moving pressure of the main piston body 221 in the main hydraulic tube 225 is set as Ppm, and when the valve ball 213 impacts the lower main piston 2212 with an impact force larger than Ppm, the main piston body 221 will move upward in the main hydraulic tube 225.

Further, one end of the main hydraulic tube 225 in connection with the side hole tube 24 is also connected to a retaining ring 2252 that is passed through by the connection rod 2213 of the main piston body 221, and an outer diameter of the upper main piston 2211 of the main piston body 221 is larger than an inner diameter of the retaining ring 2252. The retaining ring 2252 can prevent the main piston body 221 from falling out of the main hydraulic tube 225, so as to limit the position of the main piston body 221.

Figure 10:
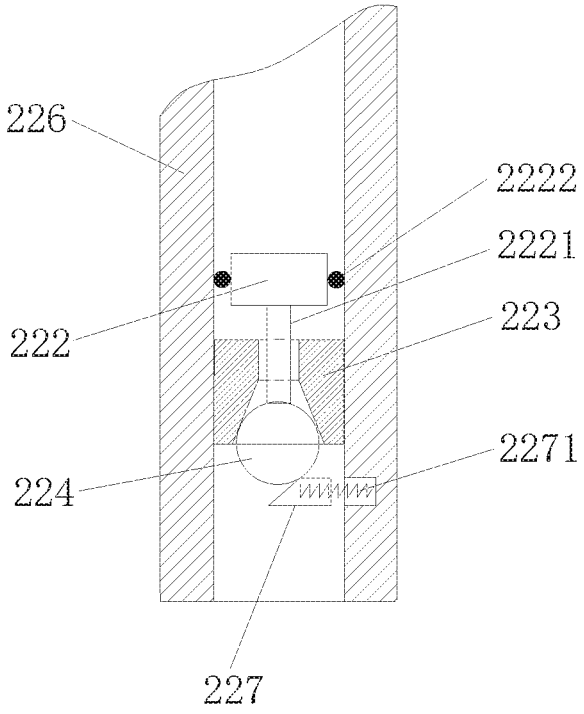
FIG. 10 is a structure view of a microbubble generation device of the present disclosure with one end of an auxiliary hydraulic tube connected to a ball valve tee.

The auxiliary hydraulic tube 226 is substantially L-shaped, one end of which is threadedly connected into the connection hole 2251 of the main hydraulic tube 225, and the other end of which is connected to a port of the ball valve tee 23. In this embodiment, as illustrated in FIG. 10, an auxiliary piston body 222 is provided in one end of the auxiliary hydraulic tube 226 connected to the ball valve tee 23, and a sealing ring 2222 is provided between the auxiliary piston body 222 and the auxiliary hydraulic tube 226. Further, said end of the auxiliary hydraulic tube 226 is further provided with a second valve seat 223 on which a blocking ball 224 is seated and provided to face the ball valve tee 23. The second valve seat 223 is located between the auxiliary piston body 222 and the ball valve tee 23, and the auxiliary piston body 222 is further connected to a push rod 2221 which can be provided to pass through the second valve seat 223.

In the present disclosure, an inner wall of one end of the auxiliary hydraulic tube 226 in connection with the ball valve tee 23 is telescopically connected to an elastic support rod 227 that is connected to the inner wall of the auxiliary hydraulic tube 226 through a spring 2271 for example. One side of the elastic support rod 227 facing the second valve seat 223 is provided with an inclined surface, so as to be contacted and pressed by the blocking ball 224 which can be blocked on the second valve seat 223 through the elastic support rod 227.

As illustrated in FIG. 10, when the gas pressure at the bottom of the auxiliary hydraulic tube 226 is higher than the liquid pressure in the upper portion thereof, the blocking ball 224 is sealed on the second valve seat 223 and abutted against it through the elastic support rod 227. When the liquid pressure gradually increases to be larger than the gas pressure, the auxiliary piston body 222 moves downward; at this time, the push rod 2221 pushes the blocking ball 224 to press the elastic support rod 227, so as to leave a pore passage until the blocking ball 224 falls into the ball valve tee 23 under the gravity.

Figure 11:
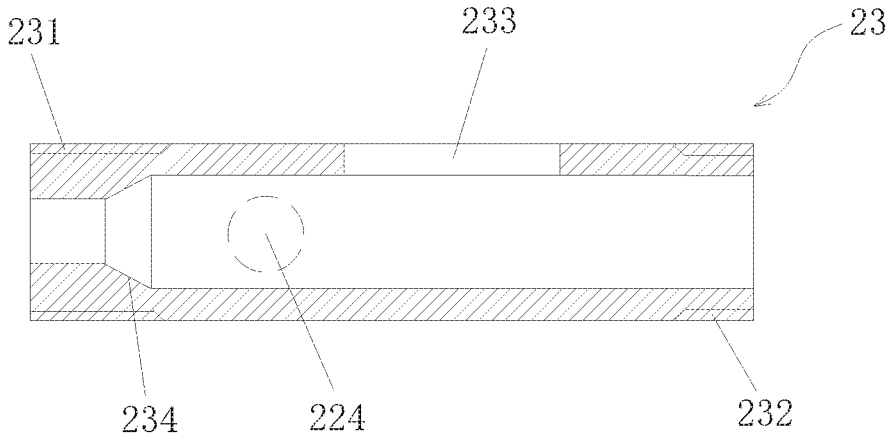
FIG. 11 is a structure view of a ball valve tee in a microbubble generation device of the present disclosure.

As illustrated in FIG. 11, the ball valve tee 23 has a substantially cylindrical shape, one end of which is provided with an external threaded section 231 for connection with the side hole 214 of the ball valve cylinder 21, the other end of which is provided with an external threaded section 232 for connection with the side hole on the core tube 12, and a peripheral sidewall of which is provided with a threaded hole 233 for connection with an end portion of the auxiliary hydraulic tube 226. In this embodiment, a valve seat 234 is provided in one end of the ball valve tee 23 connected to the ball valve cylinder 21.

The working process of the flow rate control mechanism 2 is as follows: at an initial stage, the gas enters the ball valve tee 23 from the core tube 12. Since the blocking ball 224 in the auxiliary hydraulic tube 226 is more tightly seated on the second valve seat 223 under the gas pressure, the gas enters the ball valve cylinder 21 from the unobstructed valve seat 234. If the gas flow rate exceeds a predetermined flow rate, the blocking ball 224 in the auxiliary hydraulic tube 226 will fall into the ball valve tee 23. The gas introduced into the ball valve tee 23 will push the blocking ball 224 to the valve seat 234 to play a role of sealing. At this time, the microbubble generation device no longer generates bubbles, while other devices connected in series up and down can still maintain their normal working states.

When the microbubble generation device slowly enters a wellbore from the ground surface until reaching an oil deposit (usually below 1,000 meters), the pressure outside the microbubble generation device will gradually increase from 0 MPa to an oil deposit pressure (usually above 10 MPa). If there is no special measure, the filter plate 13 will easily crack under this pressure difference. The pressure balancing mechanism 3 is designed to solve this problem.

As illustrated in FIG. 2, the pressure balancing mechanism 3 has a pressure balancing tube 31 and a fluid check valve 32 that are connected to each other. The pressure balancing tube 31 is connected to the housing 11 and communicated with the annular space 14 in the housing 11. The fluid check valve 32 enables external fluid to be introduced into the pressure balancing tube 31, so as to prevent a medium in the pressure balancing tube 31 from flowing out. In the present disclosure, the fluid check valve 32 is further connected to a filter 33 that can prevent a blockage caused by the entry of impurities of the external fluid.

During a downward movement of the microbubble generation device, the fluid (usually water) in the well will enter the annular space 14 between the filter plate 13 and the core tube 12 through the fluid check valve 32 to balance the pressures on the two sides of the filter plate 13, so that the filter plate 13 in an isobaric state and then protected. At the initial stage of the water injection, the wellbore will quickly be full of the injected water with a pressure up to 10 MPa. If the pressure balancing mechanism 3 is absent, a difference between the pressure of the externally injected water and the internal pressure of the microbubble generation device is very large, which will cause the filter plate 13 to crack when the seepage thereof is not in time. The pressure balancing mechanism 3 can protect the microbubble generation device when the ambient pressure changes drastically.

The working process of the microbubble generation device 10 is specifically described as follows.

Figure 12:
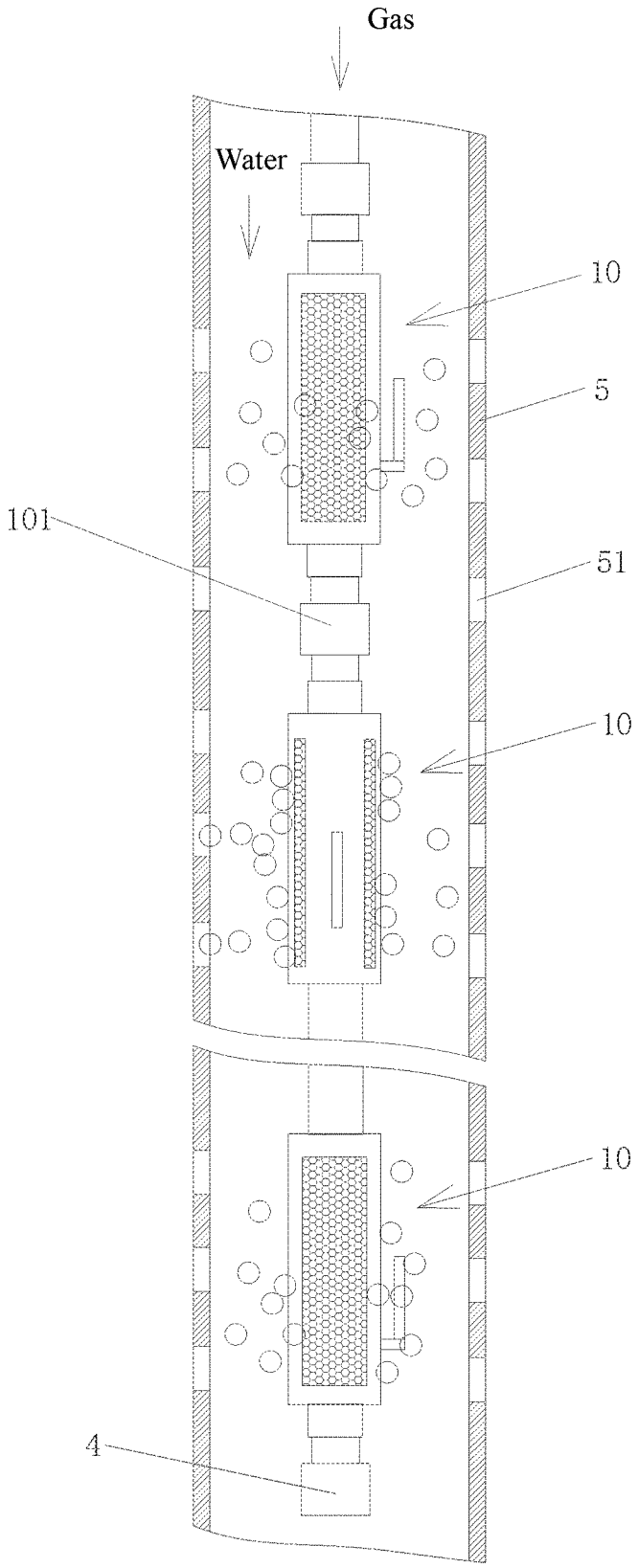
FIG. 12 is a structure view of a microbubble generation equipment of the present disclosure being placed into a casing.

As illustrated in FIG. 12, a thickness of the oil reservoir is set as 5 meters, and it is planned to provide the microbubble generation devices each having a length of 50 cm within 3 meters of the bottom of the oil reservoir. In consideration of the length of the connection nipple 101, totally four microbubble generation devices 10 need to be connected in series. The microbubble generation devices 10 are connected in series to form microbubble generation equipment, a bottom of which is provided with a plug 4 to block a bottom passage, and a top of which is connected to an air injection tubing string.

Under the influence of the formation pressure, when the tubing string is tripped in, there is injected water at a certain depth in the water injection well, and the depth value is corresponding to the fluid pressure at the oil reservoir. For example, if the fluid pressure is 5 MPa, the water column height is about 500 meters.

After the tubing string is tripped in for a depth of 500 meters, the pressure of the injected water acts on the microbubble generation device 10. When there is no gas in the gas injection tubing string, the injected water will enter the microbubble generation device 10 along the filter plate 13. Since the tripping in operation on the tubing string is gentle, the pressure increases slowly, and the annular space 14 has sufficient time to be fully filled with water to keep the pressures on the two sides of the filter plate 13 being substantially balanced. When the pressure difference of the water is higher than a pressure limit of the fluid check valve 32 of the pressure balancing mechanism 3, most of the water enters the microbubble generation device 10 along the fluid check valve 32 and the pressure balancing tube 31, thereby reducing the amount of permeation through the filter plate 13. During the remaining 500 meters of tripping in, the microbubble generation device 10 is kept in communication with the water in the wellbore, so that the filter plate 13 is protected.

After the microbubble generation equipment reach a predetermined depth, the microbubble generation operation is carried out. Firstly, water is injected into the casing 5, and the injected water enters the formation at a designed flow rate and with a pressure of Pw. At this time, each of the microbubble generation device 10 is full of water, and the gas check valve 121 connected between the core tube 12 and the flow rate control mechanism 2 is closed. The gas check valve 121 has an auxiliary protection function, and when the sealing ball 224 in the ball valve tee 23 does not tightly seal, the water in the annular space 14 can be prevented from flowing into the core tube 12, so that the injected water cannot enter the gas injection tubing string.

Gas is injected while a certain water injection amount is remained, i.e., the high-pressure gas (Pg>Pw) enters the ball valve tee 23 from the core p tube 12. The gas continues exerting an upward force on the blocking ball 224 in the auxiliary hydraulic tube 226, while entering the ball valve cylinder 21. After the flow rate is regulated by the flow rate regulation orifice plate 211, the gas lifts the valve ball 213 on the upper portion of the ball valve cylinder 21 for a certain distance, and then enters the side hole tube 24, thereby flowing into the annular space 14 between the filter plate 13 and the core tube 12 through a plurality of flow holes 241 of the side hole tube 24. Due to the density difference between the gas and the water, the gas gradually flows out from the upper portion of the filter plate 13 to generate microbubbles, so as to form a water-gas dispersion system with the water in the casing 5, and enters the oil reservoir together from a plurality of perforations 51 formed in the casing 5. In the process where the gas injection amount is gradually stabilized, the water in the annular space 14 of the microbubble generation device 10 is almost completely drained (as the gas amount increases, the internal water is squeezed out from top to bottom).

When the pressure difference of the injected gas suddenly increases (the breakage of the filter plate 13 is one of the possible reasons), the valve ball 213 is lifted obviously higher above the ball valve cylinder 21 and continuously impacts the main piston body 221 above. The main piston body 221 is pressed upward to push the pressure transmission fluid in the main hydraulic tube 225, so that the auxiliary piston body 222 in the auxiliary hydraulic tube 226 moves downward to push the blocking ball 224 below away from the sealing position. The blocking ball 224 falls into the ball valve tee 23 and is sealed on the valve seat 234 of the ball valve tee by being pushed by the laterally injected gas. At this time, the injected gas is full below the auxiliary hydraulic tube 226. When the gas pressure is higher than the pressure of the pressure transmission fluid on the top of the auxiliary piston body 222, the gas pushes the auxiliary piston body 222 to move upward, while the pressure transmission causes the primary piston body 221 in the primary hydraulic tube 225 to move downward until being blocked by the retaining ring 2252. At this time, the microbubble generation device 10 no longer works, thereby ensuring the continuous working of other devices connected in series.

Note: if there is no flow rate control, the injected gas will all enter the casing 5 through this passage when one microbubble generation device 10 is broken, and will no longer be in the form of microbubbles, while any other devices connected in series will lose its function.

In the microbubble generation device of the present disclosure, after the gas enters the upper joint 15, a part of the gas flows into the tubing string below through the core tube 12 and the lower joint 16, and the other part of the gas enters the annular space 14 between the filter plate 13 and the core tube 12 through the flow rate control mechanism 2. Under the effect of the pressure difference, the gas passes through the surface of the filter plate 13 having uniformly distributed pores to form micron-sized bubbles in the liquid environment, and those bubbles are uniformly distributed on the whole plane of the filter plate 13. When the surface of the filter plate 13 is broken, a difference between the pressures inside and outside the housing 11 increases, the gas flow rate rises, and the blocking ball 224 in the flow rate control mechanism 2 falls into the ball valve tee 23. Under the effect of the gas continuously flowing in, the blocking ball 224 is blocked on the valve seat 234 of the ball valve tee 23, thus realizing a self-blocking, preventing the gas from continuing flowing into the core tube 12, and ensuring the normal applications of the identical devices connected in series up and down.

Further, when the microbubble generation device slowly enters a wellbore from the ground surface until reaching an oil deposit (usually below 1,000 meters), the pressure outside the microbubble generation device will gradually increase from 0 MPa to an oil deposit pressure (usually above 10 MPa). If there is no special measure, the filter plate 13 will easily crack under this pressure difference. The pressure balancing mechanism 3 solves this problem. During the downward movement of the microbubble generation device 10, the fluid (usually water) in the well enters the annular space 14 through the fluid check valve 32 to balance the internal and external pressures, so that the filter plate 13 is in an isobaric state across the two sides thereof and then protected.

Furthermore, the filter plate 13 of the present disclosure is a planar plate, without structural changes such as bending, deformation and the like, and is not longitudinally limited in space, while the bubble generating surface area is large, so that many microbubbles of good uniformity can be generated, thereby achieving a good application performance.

Embodiment 2

As illustrated in FIGS. 1 to 12, the present disclosure further provides a microbubble generation equipment, comprising a plurality of microbubble generation devices 10 as described in Embodiment 1, every adjacent two of which are connected through a connection nipple 101. The specific structure, working principle and beneficial effects of the microbubble generation device in this embodiment have been described in Embodiment 1, and will not be repeated herein. The specific structure and application process of the microbubble generation device have also been described in Embodiment 1, and will not be repeated herein.

When the microbubble generation equipment of the present disclosure is industrially applied, different numbers of microbubble generation devices 10 are selected according to the thickness of the oil reservoir, and then connected in series for combined application. The injected gas is distributed to each microbubble generation device 10 connected in series along the core tube 12 thereof, respectively. This embodiment does not limit the number of the microbubble generation devices 10 in the microbubble generation equipment.

Those described above are only a few embodiments of the present disclosure, and those skilled in the art can make various changes or modifications to the embodiments of the present disclosure according to the content disclosed by the application document without deviating from the spirit and scope of the present disclosure.

The invention claimed is:

1. A microbubble generation device, comprising:

a microbubble generation mechanism having a housing and a core tube provided to pass therethrough, wherein at least one filter plate is provided on a peripheral sidewall of the housing, and an annular space is formed between the housing and the core tube;

a flow rate control mechanism provided in the annular space, and connected to the core tube that is communicated with the annular space through the flow rate control mechanism, wherein a blocking ball is provided in the flow rate control mechanism and capable of blocking the flow rate control mechanism in a state that a pressure of gas injected into the flow rate control mechanism decreases; and a pressure balancing mechanism provided outside the housing and having a pressure balancing tube and a fluid check valve connected thereto, wherein fluid outside the housing can flow into the annular space through the fluid check valve and the pressure balancing tube.

2. The microbubble generation device according to claim 1, wherein the flow rate control mechanism comprises:

a ball valve cylinder provided therein with a flow rate regulation orifice plate, wherein an upper end of the ball valve cylinder is provided with a first valve seat on which a valve ball can be seated;

a hydraulic tube having a first end and a second end, the first end of the hydraulic tube is connected to the first valve seat through a side hole tube that is provided with a plurality of flow holes and communicated with the annular space through the plurality of flow holes; and a ball valve tee connected to a lower end of the ball valve cylinder, the second end of the hydraulic tube and the core tube, respectively;

wherein a main piston body is provided to be sealable and movable in the first end of the hydraulic tube, an auxiliary piston body is provided to be sealable and movable in the second end of the hydraulic tube, and the hydraulic tube between the main piston body and the auxiliary piston body is filled with a pressure transmission fluid; the second end of the hydraulic tube is provided therein with a second valve seat, on which the blocking ball is seated and provided to face the ball valve tee, the second valve seat is located between the auxiliary piston body and the ball valve tee, and the auxiliary piston body is connected to a push rod that can be provided to pass through the second valve seat.

3. The microbubble generation device according to claim 2, wherein an elastic support rod is telescopically connected to an inner wall of the second end of the hydraulic tube, and the blocking ball can be blocked on the second valve seat through the elastic support rod.

4. The microbubble generation device according to claim 2, wherein the hydraulic tube comprises a main hydraulic tube and an auxiliary hydraulic tube connected to each other; the main hydraulic tube is connected to the side hole tube, the auxiliary hydraulic tube is connected to the ball valve tee, and the auxiliary hydraulic tube is provided with a liquid adding hole.

5. The microbubble generation device according to claim 4, wherein the main piston body has an upper main piston provided to be sealable and movable in the main hydraulic tube, and a lower main piston located in the side hole tube; a spherical groove which can be matched with the valve ball is formed on an end surface of the lower main piston.

6. The microbubble generation device according to claim 5, wherein one end of the main hydraulic tube in connection with the side hole tube is connected to a retaining ring, a connection rod is connected between the upper main piston and the lower main piston and provided to pass through the retaining ring, and an outer diameter of the upper main piston is larger than an inner diameter of the retaining ring.

7. The microbubble generation device according to claim 1, wherein a gas check valve is connected between the flow rate control mechanism and the core tube, and gas in the core tube can flow into the flow rate control mechanism through the gas check valve.

8. The microbubble generation device according to claim 2, wherein a gas check valve is connected between the flow rate control mechanism and the core tube, and gas in the core tube can flow into the flow rate control mechanism through the gas check valve.

9. The microbubble generation device according to claim 3, wherein a gas check valve is connected between the flow rate control mechanism and the core tube, and gas in the core tube can flow into the flow rate control mechanism through the gas check valve.

10. The microbubble generation device according to claim 4, wherein a gas check valve is connected between the flow rate control mechanism and the core tube, and gas in the core tube can flow into the flow rate control mechanism through the gas check valve.

11. The microbubble generation device according to claim 5, wherein a gas check valve is connected between the flow rate control mechanism and the core tube, and gas in the core tube can flow into the flow rate control mechanism through the gas check valve.

12. The microbubble generation device according to claim 6, wherein a gas check valve is connected between the flow rate control mechanism and the core tube, and gas in the core tube can flow into the flow rate control mechanism through the gas check valve.

13. The microbubble generation device according to claim 1, wherein the fluid check valve is connected to a filter.

14. The microbubble generation device according to claim 1, wherein an upper joint is in sealed connection with an upper end of the core tube, and a lower joint is in sealed connection with a lower end of the core tube; the upper joint is provided to be sealed with an upper end surface of the housing, and the lower joint is provided to be sealed with a lower end surface of the housing.

15. The microbubble generation device according to claim 14, wherein structures of the upper joint and the lower joint are the same, both comprising a connection block and an insertion portion connected thereto; the insertion portion can be in sealed connection with an end portion of the core tube, and the connection block is provided to be sealed with the upper end surface or the lower end surface of the housing; a tapered hole is provided on the connection block, a via-hole is provided on the insertion portion, and the core tube is communicated with the tapered hole through the via-hole.

16. The microbubble generation device according to claim 1, wherein the filter plate is made of titanium nanoparticles, having an average pore diameter of 2 microns.

17. The microbubble generation device according to claim 1, wherein the housing is rectangular, and each of two opposite sidewalls thereof are provided with one of the filter plates, respectively.

18. The microbubble generation device according to claim 1, wherein the filter plate is connected to the housing through a press plate frame, and a sealing ring is provided between the filter plate and the housing.

19. The microbubble generation device according to claim 1, wherein the filter plate is a flat plate.

20. A microbubble generation equipment, comprising a plurality of microbubble generation devices according to claim 1, every adjacent two of which are connected through a connection nipple.

* * * * *